US010960659B2

(12) United States Patent
Arici

(10) Patent No.: US 10,960,659 B2
(45) Date of Patent: Mar. 30, 2021

(54) SYSTEM AND METHOD FOR OVERPRINTING ON PACKAGES AND/OR CONTAINERS OF DIFFERENT FORMATS

(71) Applicant: ROTOPRINT SOVRASTAMPA S.R.L., Lainate (IT)

(72) Inventor: Gian Carlo Arici, Lainate (IT)

(73) Assignee: ROTOPRINT SOVRASTAMPA S.R.L., Milan (IT)

( * ) Notice: Subject to any disclaimer, the term of this patent is extended or adjusted under 35 U.S.C. 154(b) by 0 days.

(21) Appl. No.: 15/323,095

(22) PCT Filed: Jun. 16, 2015

(86) PCT No.: PCT/IB2015/054543

§ 371 (c)(1),
(2) Date: Dec. 29, 2016

(87) PCT Pub. No.: WO2016/001786

PCT Pub. Date: Jan. 7, 2016

(65) Prior Publication Data

US 2017/0136763 A1 May 18, 2017

(30) Foreign Application Priority Data

Jul. 2, 2014 (IT) ..... MI2014A001202

(51) Int. Cl.
*B41F 33/00* (2006.01)
*B41F 17/26* (2006.01)
(Continued)

(52) U.S. Cl.
CPC ..... *B41F 33/00* (2013.01); *B41F 5/24* (2013.01); *B41F 17/26* (2013.01); *B41F 21/00* (2013.01);
(Continued)

(58) Field of Classification Search
CPC .. B41F 5/24; B41F 17/26; B41F 33/00; B41F 33/0081; B41F 13/12; B41F 13/14;
(Continued)

(56) References Cited

U.S. PATENT DOCUMENTS 2,118,816 A * 5/1938 Lamatsch ..... B41F 13/68 226/31
4,177,730 A * 12/1979 Schriber ..... B41F 13/025 101/219
(Continued)

FOREIGN PATENT DOCUMENTS

DE 10 2007 021 787 A1 11/2008
DE 10 2013 111 534 A1 5/2014
(Continued)

OTHER PUBLICATIONS

PCT International Search Report for PCT Counterpart Application No. PCT/IB2015/054543, 4 pp., (dated Aug. 21, 2015).
(Continued)

*Primary Examiner* — Matthew G Marini
*Assistant Examiner* — Marissa Ferguson-Samreth
(74) *Attorney, Agent, or Firm* — Womble Bond Dickinson (US) LLP

(57) ABSTRACT

The invention describes a system (1) for overprinting on formats, comprising at least one printing unit (2), having first actuation means (14), and also comprising format supplying means (6, 7), format collecting means (9), at least one conveyor belt (5), second actuation means (10), and control means (11, 12, 13). The at least one printing unit (2) comprises at least one rotatable printing cylinder (3), having printing zones at the surface, and also first actuation means (14), configured to drive, in a controllable manner, the rotation of the printing cylinder (3). The format supplying means (6, 7) are configured to supply the system with one or
(Continued)

more formats (4), each being intended to be overprinted in preset zones to be overprinted. The format collecting means (9) are configured to collect the one or more formats (8) once printed. The at least one conveyor belt (5) is configured to arrange, for the aforementioned one or more formats (4), an advancement path comprised between the format supplying means (6, 7) and the format collecting means (9). The advancement path passes through the printing unit (2). The second actuation means (10) are configured to drive, in a controllable manner, the advancement of the conveyor belt (4) along the advancement path, upstream of the printing unit (2) in the advancement direction. The control means (11, 12, 13) are configured to control, in a coordinated manner, both the first actuation means (14) and the second actuation means (10), so as to determine at each moment a correspondence of the preset zones to be overprinted of the format (4) with respective printing zones of the printing cylinder (3).

12 Claims, 1 Drawing Sheet

(51) Int. Cl.

| | |
|---|---|
| ***B41F 21/00*** | (2006.01) |
| ***B41F 5/24*** | (2006.01) |
| *B65H 9/00* | (2006.01) |
| *B31B 50/02* | (2017.01) |
| *B31B 50/04* | (2017.01) |

(52) U.S. Cl.
CPC ..... *B41F 33/0081* (2013.01); *B31B 50/02* (2017.08); *B31B 50/04* (2017.08); *B41P 2217/11* (2013.01); *B65H 9/00* (2013.01)

(58) Field of Classification Search
CPC ..... B41F 13/025; B41F 21/08; B41F 21/00; B41P 2217/11; B65H 9/00; B31B 50/00; B31B 50/006; B31B 50/02; B31B 50/04; B31B 50/06; B31B 50/88
USPC ..... 101/481, 485, 486
See application file for complete search history.

(56) References Cited

U.S. PATENT DOCUMENTS

| | | | | | |
|---|---|---|---|---|---|
| 4,334,645 | A * | 6/1982 | Cunnington | B41F 13/025 | 101/227 |
| 4,369,703 | A * | 1/1983 | Jarach | B41F 13/0032 | 101/216 |
| 5,074,539 | A * | 12/1991 | Wells | B65H 3/042 | 271/12 |
| 5,383,392 | A * | 1/1995 | Kowalewski | B41F 19/00 | 101/183 |
| 5,584,246 | A * | 12/1996 | Steffen | B41F 7/08 | 101/181 |
| 5,809,893 | A * | 9/1998 | Gamperling | B65H 31/32 | 101/227 |
| 8,196,511 | B2 * | 6/2012 | Ismael | B41F 17/001 | 101/163 |
| 2007/0266879 | A1 * | 11/2007 | Schultze | B41F 33/00 | 101/485 |
| 2011/0050767 | A1 * | 3/2011 | Knauer | B41F 11/00 | 347/9 |

FOREIGN PATENT DOCUMENTS

| | | | | |
|---|---|---|---|---|
| EP | 0464001 | * | 1/1992 | B41F 17/00 |
| EP | 0 581 378 A1 | | 2/1994 | |
| EP | 2436518 | * | 4/2012 | B41F 13/025 |
| IT | 1033277 B | | 7/1979 | |

OTHER PUBLICATIONS

PCT Written Opinion of the International Searching Authority for PCT Counterpart Application No. PCT/IB2015/054543, 5 pp., (dated Aug. 21, 2015).

Research Report and Written Opinion issued by the Ministry of Economic Development—General Direction of Production Development and Competitiveness—Italian Patent and Trademark Office for corresponding Italian Patent Application No. ITMI20141202, 7 pp., (dated Feb. 24, 2015).

* cited by examiner

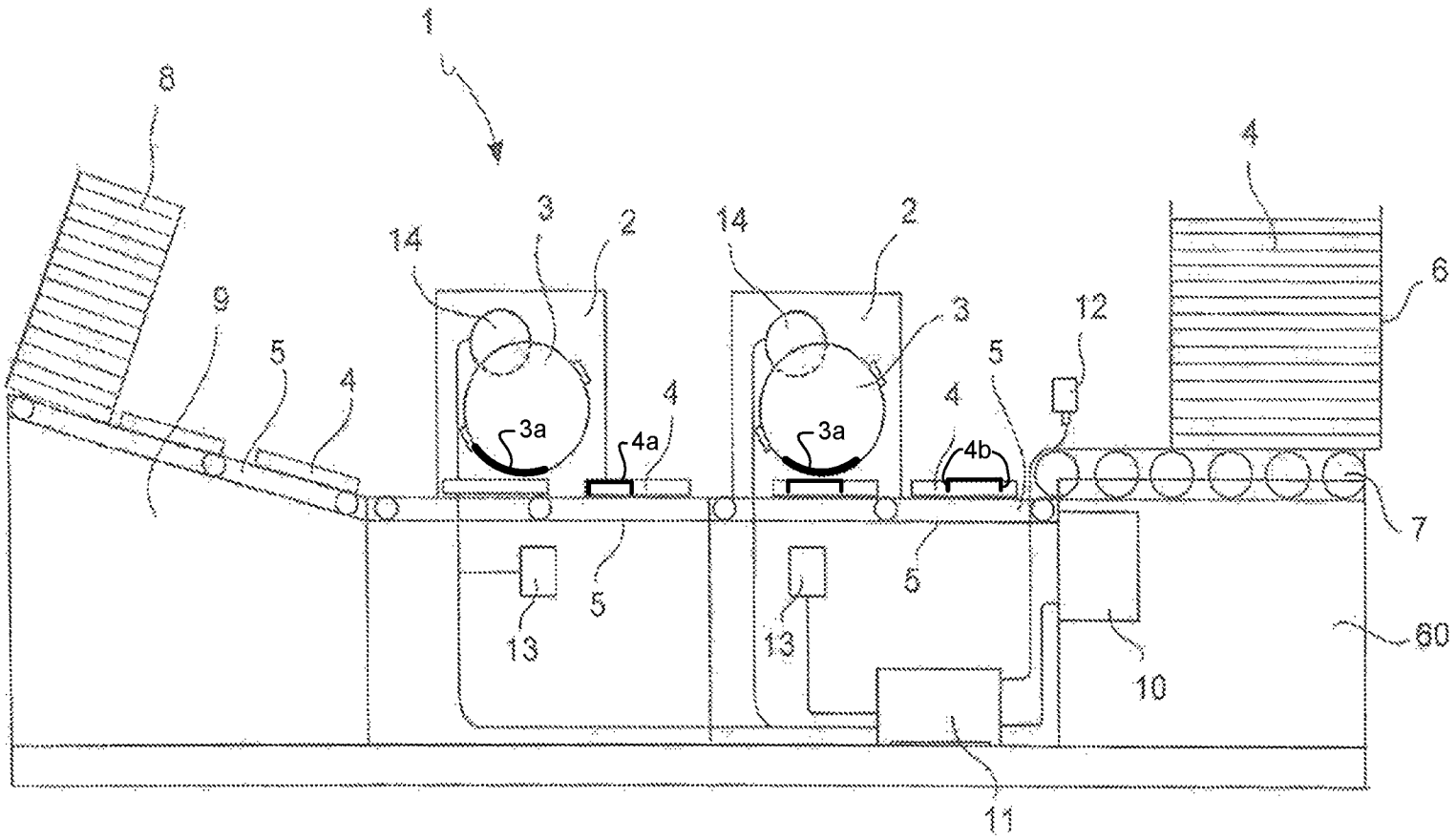
1
2
3
3a
4
4a
4b
5
6
7
8
9
10
11
12
13
14
60

SYSTEM AND METHOD FOR OVERPRINTING ON PACKAGES AND/OR CONTAINERS OF DIFFERENT FORMATS

CROSS-REFERENCE TO RELATED APPLICATIONS

This patent application is a U.S. National Phase Application under 35 U.S.C. § 371 of International Application No. PCT/IB2015/054543, filed Jun. 16, 2015, entitled SYSTEM AND METHOD FOR OVERPRINTING ON PACKAGES AND/OR CONTAINERS OF DIFFERENT FORMATS, which claims priority to Italian Patent Application No. MI2014A001202, filed May 2, 2014.

FIELD OF APPLICATION

The present invention relates to the technical field of overprinting on packages and/or containers in format. In particular, the invention refers to a system and a related method for overprinting on formats through a continuous operation so as to overprint a plurality of packages and/or containers in sequence, each at predetermined positions.

DESCRIPTION OF THE PRIOR ART

Packages or containers of items and products of numerous sectors of goods, for example the food industry, are commonly made of paper, micro-corrugated cardboard or polylaminated cardboard supports that can be defined in general as "formats".

Usually, such formats have prints on their surface concerning brands and commercial inscriptions of various types, compositions of the products contained, advertising and possibly other information of any kind.

Often, there is the need to partially modify some of the printed elements on the format, for example the barcode, or the company name, or the ingredients of a product, which can undergo numerous and sometimes unforeseen changes.

If in storage there are packages or containers printed with inscriptions and indications that are now defunct, it is clear that there would be an advantage in allowing the reuse of such packages and/or containers (i.e., "formats"), thus avoiding the economic loss, which sometimes may even be substantial, deriving from discarding the obsolete formats.

Theoretically, in order to partially satisfy such a requirement, it could be considered to "overprint" such formats, in known positions, at the inscriptions or images to be corrected.

However, the known solutions for overprinting, if applied to formats, would at most allow each format to be overprinted individually, after having positioned it very precisely at a printing element, which in turn must be able to print with high precision and minimal spatial tolerances. For this reason, the use of overprinting systems and methods would be relatively slow, complex and expensive, to the point of actually making such systems and methods inapplicable to the context considered here.

In brief, therefore, there is a need to significantly extend the applicability of overprinting methods to overprinting on single formats.

Such a requirement is currently not met by known overprinting systems and methods.

Therefore, the purpose of the present invention is to devise and provide an improved system for overprinting on formats such as to satisfy the aforementioned requirements, and capable of avoiding the drawbacks described above with reference to the prior art. Another purpose of the present invention is to devise and provide a method for overprinting on formats, carried out through the aforementioned overprinting system, which is particularly effective in achieving the indicated purposes.

SUMMARY OF THE INVENTION

Such a purpose is accomplished by a system and method for overprinting on formats according to the independent claims. Further embodiments of the system and method are defined in the dependent claims.

BRIEF DESCRIPTION OF THE DRAWINGS

Further characteristics and advantages of the overprinting system and method, according to the invention, will become clearer from the following description of preferred embodiments, given for indicating and not limiting purposes, with reference to the attached FIGURE.

The FIGURE represents a structural diagram of an embodiment of the system according to the invention.

DETAILED DESCRIPTION

With reference to the FIGURE, a system 1 for overprinting on formats according to the invention is described.

Such a system 1 comprises at least one printing unit 2 having first actuation means 14, and also comprises format supplying means 6, 7, format collecting means 9, at least one conveyor belt 5, second actuation means 10, and control means 11, 12, 13.

The at least one printing unit 2 comprises at least one rotatable printing cylinder 3, having printing zones 3*a* at the surface thereof, and also, as already noted, first actuation means 14, configured to drive, in a controllable manner, the rotation of the printing cylinder 3.

The format supplying means 6, 7 are configured to supply the system with one or more formats 4, each intended to be overprinted in preset zones 4*a* to be overprinted.

The format collecting means 9 are configured to collect the one or more formats 8 once they have been printed.

The at least one conveyor belt 5 is configured to arrange, for the aforementioned one or more formats 4, an advancement path comprised between the format supplying means 6, 7 and the format collecting means 9. The advancement path passes through the printing unit 2.

The second actuation means 10 are configured to drive, in a controllable manner, the advancement of the conveyor belt 5 along the advancement path, upstream of the printing unit 2 in the advancement direction.

The control means 11, 12, 13 are configured to control, in a coordinated manner, both the first actuation means 14 and the second actuation means 10, so as to determine at each moment a correspondence of the preset zones 4*a* to be overprinted of the format 4 with respective printing zones 3*a* of the printing cylinder 3.

As auxiliary information so as to better understand the invention, it should be noted that each of the formats 4 can be any type of package and/or container suitable for being printed.

Each of the formats 4 can also be, for example, in a folded or squashed configuration, so as to face the surface(s) intended to be printed towards the printing cylinder.

In particular, each of the formats 4 can be for example a package made of paper, cardboard, or polylaminated materials, or micro-corrugated cardboard.

In a preferred context of application, such a format is an already-printed format, on which the overprint must be carried out; however, the system of the invention can operate in the same way for a first print on a new format: also in this case it may, indeed, be useful to have accurate control of the printing zones 3*a*, which is ensured by the system of the present invention, in the way described here.

The preset zones 4*a* to be overprinted, in different applications made possible by the system, can vary widely: for example, even very small formats parts that must be corrected, and on which it is necessary to intervene, for overprinting, with high spatial precision, in order to recycle the format.

In accordance with an embodiment, the system 1 is a configurable overprint machine 1, suitable to sequentially operate on a plurality of single formats 4 supplied to it. Such a system 1 is thus capable of operating in a continuous way, for example through operating cycles that are sufficiently long as to allow the overprinting of numerous (even hundreds or more) formats in sequence.

Hereafter, details and examples implementing the components of the system 1, already mentioned above, will be provided.

The printing unit 2 is suitable for printing through a contact action between the printing cylinder 3, while it rotates, and a format 4, at the moment when such a format is taken to adhere to the printing cylinder 3.

According to an embodiment, the system 1 is suitable to operate with different types of printing units, and is configured so that each of the at least one printing units 2 can be replaced with a respective printing unit of a different type.

According to an implementation option, each of the at least one printing unit 2 is a rotogravure printing unit, per se known, applying rotogravure prints on the formats 4. According to another option of implementation, each of the at least one printing unit 2 is a flexographic printing unit, per se known, suitable for applying prints on the formats 4 by flexographic technique.

According to a further implementation option, each of the at least one printing unit 2 is a rota-offset printing unit, per se known, suitable for applying prints on the formats 4 by rota-offset technique.

In accordance with a particular embodiment, the system 1 comprises a plurality of printing units 2, arranged sequentially along the advancement path, so as to operate in sequence on the formats that pass along the advancement path. Such an embodiment is illustrated in the FIGURE, in which two printing units 2 are shown as examples.

According to an implementation option, each of such a plurality of printing units 2 is configured to print a respective colour, applying it in the appropriate zones on the format 4.

The aforementioned first actuation means 14 of the printing unit 2 are configured to advance or delay the rotation of the printing cylinder 3 with respect to the position of the format 4 that reaches the printing unit, until it completely compensates for possible position mismatches indicated by the control means 11, 12, 13.

According to an implementation option, the first actuation means 14 of the printing unit 2 comprise an actuator 14 of the "harmonic drive" type, per se known, the efficiency of which is known in the application considered.

In accordance with an embodiment of the system 1, the format supplying means 6, 7 comprise at least one support member 6, configured to support a plurality of formats 4 in stacked position, and further comprise an insertion member 7 configured to insert in succession the formats of the stack on the conveyor belt 5, placing them in a position arranged for the successive overprint.

According to an implementation option, the system 1 comprises a support element 60, configured to support the other aforementioned elements of the system (in particular the conveyor belt 5 and the printing units 2). Such a support element can comprise many modules, suitable for supporting the different elements of the system 1.

According to an implementation option, the insertion member 7 is also configured to adjust, under the control of the control means, the frequency of insertion of the one or more formats 4 on the conveyor belt, or carpet, based on the dimension of the one or more formats 4, so as to adapt the system 1 to operate on formats having different dimensions.

In accordance with an embodiment of the system 1, the format collecting means 9 comprise at least one collecting element 9 configured to collect, stack and support a plurality of formats 8, once they have been printed.

According to an option of implementation, the conveyor belt 5 (or carpet 5) is a conveyor belt of a per se known type. The dimensions in width can vary greatly (for example, from a few tens of cm, up to well over a metre), and can be defined as a function of a maximum predictable width of the formats to be transported.

As already observed, the advancing of the conveyor belt 5 along the advancement path, in particular the speed and/or the instantaneous position of the conveyor belt 5, are adjusted by second actuation means 10, controlled by the control means.

It should be observed that the advancement direction of the belt 5 allows the relative positions of the formats, with respect to the elements of the system, to be defined as "upstream" or "downstream" positions.

According to an option of implementation, the second actuation means 10 comprise a actuator 10 of the "brushless" type, per se known, the effectiveness of which is known in the field of application considered.

In particular, the second actuation means 10 are able to cause a constant nominal movement (at controlled speed) of the conveyor belt 5, to sequentially transport the formats from the format supplying means 7 to the printing unit 2, and then to the format collecting means 9. The second actuation means 10 are also able to vary, in a controlled manner and with very accurate precision, such movement, determining controlled "perturbations" thereof (for example by varying the instantaneous speed of the conveyor belt 5), in order to correct and compensate for possible mismatches detected between zones to be overprinted of the format 4 and printing zones 3*a* of the printing cylinder 3, as will be illustrated hereafter.

With reference to the important aspects relative to the control of the operation of the system 1, it should be observed that the overprinting action, made possible by the system 1, takes place at the moment when a predetermined zone to be overprinted, in each format 4, when it reaches the printing unit 2, comes into contact with a corresponding printing zone of the printing cylinder 3. In order that the system acts quickly and accurately, it is crucial that at each moment there is a very precise spatial 5 correspondence between the aforementioned predetermined zones to be overprinted and corresponding printing zone.

For this purpose, as already described above, the system of the invention provides to accurately control, through the control means 11, 12, 13, both the movement of the format 4, by means of an adjustment of the movement of the conveyor belt 5, and the rotation movement of the printing cylinder 3, as well as their coordination.

Although in principle a certain level of coordination between the aforementioned movements, and therefore of adjustment of possible mismatches, can be obtained by acting on just one of the two variables (i.e., on just one of the two movements), the ability of the present system to act and control both of the variables (i.e., both of the movements) makes it possible to obtain better coordination, and therefore to determine a faster correction of the position mismatches or discrepancies. Consequently, the precision of overprinting is always kept at high levels, and is in any case recovered, within satisfactory levels, very quickly.

The dual control action, carried out by the present system, may for example determine an advantageous cooperation and complementarity of effects. Indeed, a variation of movement of the conveyor belt 5 is important for the readjustment of the operative conditions of the system, whereas a variation of the rotation speed of the printing cylinder 3 immediately reflects in a variation of the relative position of the printing zone of the cylinder with respect to the predetermined overprint zone of the format 4 that is already in proximity of the printing cylinder, and therefore it is important to carry out instantaneous corrections on a single format, where necessary.

Now considering in greater detail the control means 11, 12, 13 of the system 1, it should be observed that, according to an example of implementation, they can comprise a detection device 12, 13 and a processing unit 11.

The detection device 12, 13 is configured to detect a mutual positioning between the preset zones 4*a* to be overprinted of the one or more formats 4 and the respective printing zones of the printing cylinder 3.

The processing unit 11 is operatively connected with the detection device 12, 13 to receive signals indicative of the aforementioned mutual positioning, and is configured to determine first control signals for the first actuation means 14 and second control signals for the second actuation means 10, based on the received signals indicative of mutual positioning.

Moreover, the first actuation means 14 and the second actuation means 10 are operatively connected with the processing unit 11 to receive the aforementioned first and second control signals, respectively.

The processing unit 11 may comprise one or more electronic processors, per se known, in which it is possible to store software programmes that implement control algorithms for generating control signals suitable for managing (for example, in the way illustrated earlier) the movements of the conveyor belt 5 and of the printing cylinder 3, as well as the coordination thereof.

In a particular implementation example, the processing unit comprises a main system processor, suitable for operating according to what described above, and also an auxiliary processor, operatively connected both to the central processor and to the aforementioned insertion member 7, to adjust the frequency of insertion of the formats 4 on the conveyor belt 5.

In accordance with an implementation example, each format 4 comprises recognition marks 4*b*, at the preset zones 4*a* to be overprinted.

In addition, the detection device 12, 13 comprises a reading head 12 and a sensor 13.

The reading head 12 is arranged along the advancement path, downstream of the insertion member 7 and upstream of the printing unit 2, and is configured to determine a position of the respective format 4 on the advancement path.

The sensor 13 is arranged in the proximity of the printing cylinder 3, and is configured to read the recognition marks 4*b* and detect a relative position of a format 4, when it comes in proximity of the printing unit 2, with respect to the printing cylinder 3.

In accordance with an implementation option, the processing unit 11 is configured to control the second actuation means 10, based on the determination carried out by the reading head 12, so as to adjust a speed of the conveyor belt 5, and is moreover configured to control the first actuation means 14, based on the determination carried out by the sensor 13, so as to adjust a rotation speed of the printing cylinder 3.

In this case, the aforementioned signals indicative of mutual positioning are signals generated by the reading head 12 and by the sensor 13. Such signals are sent to the processing unit 11, providing it with sufficient basic information, from which the processing unit 11 is able to determine the commands to be imparted to the first and to the second actuation means, and to generate the respective first and second control signals.

Therefore, such control signals, suitably generated by the processing unit 11, based on the detections carried out by the detection device 12, 13 result in a simultaneous intervention of the first and second actuation means.

As already observed, in a significant example of application, the system 1 is configured to operate on formats in which the preset zones 4*a* to be overprinted of the format 4 are zones of packages previously printed that must be modified in a controlled manner to as to obtain new packages, so as to allow the recycling of the printed material.

Hereafter, a method for overprinting on formats according to the invention will be described; the method can be carried out by the overprinting system 1 according to the invention in the different embodiments described above.

In particular, a method for overprinting on formats, having preset zones 4*a* to be overprinted, is described. The method comprises the following steps: inserting a format 4 to be overprinted on a conveyor belt 5, suitable to define an advancement path passing through a printing unit 2 comprising at least one rotatable printing cylinder 3, having printing zones 3*a* at the surface; then, overprinting such preset zones 4*a* to be overprinted of the format 4 through a contact with corresponding printing zones 3*a* of the printing cylinder 3, upon passage of the format 4 in the printing unit 2; moreover, driving, in a controllable manner, the advancement of the format 4 along the advancement path, upstream of the printing unit 2 in the advancement direction, by second actuation means 10, and driving, in a controllable manner, the rotation of the printing cylinder 3, by first actuation means 14.

The aforementioned steps of driving the advancement of the format and driving the rotation of the printing cylinder comprise the steps of controlling, in a coordinated manner, by control means 11, 12, 13, both the first actuation means 14 and the second actuation means 10, so as to determine at each moment a correspondence of the preset zones 4*a* to be overprinted of the format 4 with respective printing zones 3*a* of the printing cylinder 3.

According to a particular implementation example, the method is suitable for operating on a plurality of formats 4, in which the formats 4 are initially stacked, and are then inserted in sequence, starting from an end of the stack, on the conveyor belt 5, with a controlled frequency.

In accordance with a particular implementation example, the method is suitable for operating on formats each of which contains a set of configurations and/or of inscriptions that must be modified in a controllable manner at the preset zones 4*a* to be overprinted, so as to allow the recycling of the material of the format.

According to other particular examples of implementation of the method, the steps of the method are carried out through an overprinting system 1 according to any one of the embodiments and the examples of implementation already described above.

As can be seen, the purpose of the present invention is accomplished by the system and by the method described above.

Indeed, based on what is stated above, it is clear that the system according to the 5 invention is able, by virtue of its characteristics, to sequentially and continuously printing and/or overprinting on a plurality of single formats, each format being suitable to be treated individually, although in a continuous process cycle. Such a characteristic makes the overprinting methods applicable for the recovery of a plurality of formats and/or packages and/or containers.

Moreover, again based on the structural and functional characteristics, described above, the system of the present invention is able to ensure remarkable accuracy in the overprinting precision, even on zones of small dimensions and with small tolerances.

In addition, the system is substantially versatile, since it can adapt to operate on formats of various dimensions, thanks to the above-illustrated system functionality regarding the adjustment of the frequency of insertion of the formats on the conveyor belt.

Similar considerations apply for the method according to the invention, described above.

A man skilled in the art can bring modifications, adaptations and replacements of elements with other functionally equivalent ones to the embodiments of the system and of the method for overprinting on formats according to the invention, described above, also in conjunction with the prior art, even creating hybrid implementations, without departing from the scope of the following claims. Each of the characteristics described as belonging to a possible embodiment can be made independently from the other embodiments described.

It should also be noted that the term "comprising" does not exclude other elements or steps, the term "one" or "a" does not exclude a plurality. Moreover, the figures are not necessarily to scale; rather importance is generally given to the illustrations of the principles of the present invention.

What is claimed is:

1. A system for overprinting on formats, comprising:

at least one printing unit comprising at least one rotatable printing cylinder, having printing zones at a surface thereof, and further comprising first actuation means, configured to drive, in a controllable manner, a rotation of the printing cylinder;

format supplying means configured to supply the system with one or more formats, each being intended to be overprinted in preset zones to be overprinted;

format collecting means configured to collect the one or more formats once the one or more formats have been printed;

at least one conveyor belt configured to arrange, for said one or more formats, an advancement path comprised between the format supplying means and the format collecting means, and passing through the printing unit;

second actuation means, configured to drive, in a controllable manner, an advancement of the conveyor belt along the advancement path, upstream of the printing unit in an advancement direction;

control means configured to control in a coordinated manner both the first actuation means and the second actuation means, so as to determine at each moment a correspondence of the preset zones to be overprinted of the one or more formats with respective printing zones of the printing cylinder, wherein the control means are configured to control, in a coordinated manner and simultaneously, both the first actuating means to change the rotation speed of the printing cylinder, and the second actuating means to change the speed of the advancement of the conveyor belt, to compensate for relative position shifts between the preset zones to be overprinted of the format and the respective printing zones of the printing cylinder;

wherein the format supplying means comprise at least one support member configured to support a plurality of formats in a stack, and further comprise an insertion member configured to insert in succession the formats of the stack on the conveyor belt, placing them in a position arranged for the successive overprint, and wherein the insertion member is further configured to adjust, under control of the control means, a frequency of insertion of the one or more formats on the conveyor belt, based on a dimension of the one or more formats, so as to adapt the system to operate on formats having different dimensions.

2. The system according to claim 1, wherein the system is a configurable overprint machine, suitable to sequentially operate on a plurality of single formats supplied therein.

3. The system according to claim 1, wherein the one or more formats are packages made of paper, polylaminated cardboard or materials, micro-corrugated cardboard.

4. The system according to claim 1, suitable to operate with different types of printing units, and wherein each of the at least one printing unit can be replaced by a respective printing unit of a different type.

5. The system according to claim 4, wherein each of said at least one printing unit is a rotogravure printing unit, or a flexographic printing unit, or a roto-offset printing unit.

6. The system according to claim 1, comprising a plurality of printing units, arranged sequentially along the advancement path, so as to sequentially operate on the one or more formats passing along the advancement path.

7. The system according to claim 1, wherein the control means comprise:

a detection device for detecting mutual positioning between the preset zones to be overprinted of the one or more formats and the respective printing zones of the printing cylinder;

a processing unit, operatively connected to said detection device to receive signals indicative of said mutual positioning, and configured to determine first control signals for the first actuation means, and second control signals for the second actuation means, based on said received signals indicative of mutual positioning;

and wherein the first actuation means and the second actuation means are operatively connected to said processing unit to receive said first and second control signals, respectively.

8. The system according to claim 7, wherein each format comprises recognition marks, at said preset zones to be overprinted, and wherein the detection device comprises:

a reading head arranged along the advancement path, downstream of the insertion member and upstream of the printing unit, configured to determine a position of a corresponding format along the advancement path;

a sensor arranged in proximity of the printing cylinder, configured to read said recognition marks and to detect a relative position of a format, when arriving in proximity of the printing unit, with respect to the printing cylinder.

9. The system according to claim 8, wherein the processing unit is configured to control the second actuation means, based on a determination carried out by the reading head, so as to adjust a speed of the conveyor belt, and further configured to control the first actuation means, based on the determination carried out by the sensor, so as to adjust a rotation speed of the printing cylinder.

10. The system according to claim 1 wherein:

the first actuation means includes a harmonic drive;

the second actuation means includes a brushless actuator;

the format collecting means includes a collecting element configured to collect, stack, and support a plurality of formats; and the control means includes a detection device and a processing unit coupled to the detection device.

11. A method for overprinting on formats, having preset zones to be overprinted, comprising:

inserting a format to be overprinted on a conveyor belt, suitable to define an advancement path passing through a printing unit comprising at least one rotatable printing cylinder, having printing zones at a surface thereof;

overprinting said preset zones to be overprinted of the format through a contact with said corresponding printing zones of the printing cylinder, upon passage of the format in the printing unit;

driving, in a controllable manner, an advancement of the format along the advancement path, upstream of the printing unit in an advancement direction, by second actuation means; and driving, in a controllable manner, a rotation of printing cylinder, by first actuation means;

wherein driving the advancement of the format and driving the rotation of the printing cylinder comprise controlling in a coordinated manner, by control means, both the first actuation means and the second actuation means, so as to determine at each moment a correspondence of the preset zones to be overprinted of the format with respective printing zones of the printing cylinder, wherein controlling comprises controlling, in a coordinated manner and simultaneously, both the first actuating means to change the rotation speed of the printing cylinder, and the second actuating means to change the speed of the advancement of the conveyor belt, to compensate for relative position shifts between the preset zones to be overprinted of the format and the respective printing zones of the printing cylinder, and wherein the method is suitable to operate on a plurality of formats, wherein the formats are stacked, and are inserted sequentially on the conveyor belt, starting from an end of a stack, with a controlled frequency.

12. The method according to claim 11 wherein:

the first actuation means includes a harmonic drive;

the second actuation means includes a brushless actuator;

the format collecting means includes a collecting element configured to collect, stack, and support a plurality of formats; and the control means includes a detection device and a processing unit coupled to the detection device.

* * * * *